US007568252B2

(12) United States Patent
Fraundorfer

(10) Patent No.: US 7,568,252 B2
(45) Date of Patent: Aug. 4, 2009

(54) ATTACHMENTS FOR TRANSPORTING AND LAUNCHING MILITARY BRIDGES

(75) Inventor: Werner Fraundorfer, Bedesbach (DE)

(73) Assignee: General Dynamics European Land Systems-Germany GmbH, Kaiserslautern (DE)

( * ) Notice: Subject to any disclaimer, the term of this patent is extended or adjusted under 35 U.S.C. 154(b) by 0 days.

(21) Appl. No.: 12/202,670

(22) Filed: Sep. 2, 2008

(65) Prior Publication Data

US 2009/0056040 A1 Mar. 5, 2009

(30) Foreign Application Priority Data

Sep. 1, 2007 (DE) ..... 10 2007 041 579

(51) Int. Cl.
*E01D 15/127* (2006.01)
*E01D 15/12* (2006.01)

(52) U.S. Cl. ..... 14/2.5; 14/2.4

(58) Field of Classification Search ..... 14/2.4, 14/2.5

See application file for complete search history.

(56) References Cited

U.S. PATENT DOCUMENTS

| | | | | |
|---|---|---|---|---|
| 2,556,175 | A | 6/1951 | Frost | |
| 3,492,683 | A * | 2/1970 | Kinzel et al. | 14/2.5 |
| 4,288,881 | A * | 9/1981 | Mahncke et al. | 14/2.5 |
| 4,663,793 | A * | 5/1987 | Parramore | 14/2.5 |
| 5,042,102 | A | 8/1991 | Kahmann et al. | |
| 5,179,751 | A * | 1/1993 | Wiedeck | 14/2.4 |
| 5,276,930 | A * | 1/1994 | Parramore | 14/2.5 |
| 5,276,931 | A * | 1/1994 | Karcher et al. | 14/2.5 |
| 5,363,527 | A * | 11/1994 | Rainaud et al. | 14/2.4 |
| 5,507,057 | A * | 4/1996 | Diefendahl et al. | 14/2.4 |
| 5,937,468 | A * | 8/1999 | Wiedeck et al. | 14/2.5 |
| 7,174,591 | B2 * | 2/2007 | Bertrand et al. | 14/2.5 |

FOREIGN PATENT DOCUMENTS

| | | |
|---|---|---|
| DE | 39 32 742 A1 | 4/1991 |
| DE | 40 09 354 A1 | 9/1991 |
| DE | 41 23 092 A1 | 1/1993 |
| DE | 44 34 027 A1 | 4/1996 |
| DE | 101 27 136 A1 | 12/2002 |
| EP | 0 374 019 A1 | 6/1990 |
| EP | 0 407 235 A1 | 1/1991 |
| EP | 0 391 149 B2 | 2/1996 |

* cited by examiner

*Primary Examiner*—Raymond W Addie
(74) *Attorney, Agent, or Firm*—Muncy, Geissler, Olds & Lowe, PLLC

(57) ABSTRACT

An attachment for transporting and launching military bridges with light armored vehicles is provided. The attachment includes a deck adapter for removable attachment to the upper deck of the vehicle, and a front adapter to be removably attached to the bow of the vehicle. The front adapter has a framework matched to the bow of the vehicle and is removably attached to the bow. This includes a launching beam, attached to the framework in a pivoting manner, with a motor-driven pinion for moving the bridge. In addition, a support foot is attached to the framework in a pivoting manner. Lifting cylinders are provided for raising and lowering the launching beam and the support foot.

7 Claims, 6 Drawing Sheets

ATTACHMENTS FOR TRANSPORTING AND LAUNCHING MILITARY BRIDGES

This nonprovisional application claims priority under 35 U.S.C. § 119(a) to German Patent Application No. 10 2007 007 041 579.8, which was filed in Germany on Sep. 1, 2007, and which is herein incorporated by reference.

BACKGROUND OF THE INVENTION

1. Field of the Invention

The present invention relates to attachments for transporting and launching military bridges with a light armored vehicle.

2. Description of the Background Art

Military bridges can be transported using airborne vehicles, rail vehicles, water and/or land vehicles. They are launched over obstacles by special bridge-launching vehicles. Bridges with long spans in excess of 20 m are known under the designations "Biber" and "Leguan." See also DE 44 34 027 C, DE 41 23 092 A, EP 0 374 019 A and U.S. Pat. No. 5,042,102. These bridges are launched with tracked armored vehicles.

Bridges with relatively short spans can also be transported and launched using trucks. See also U.S. Pat. No. 2,556,175, DE 39 32 742 C, EP 0 391 149 B, EP 0 407 235 A, DE 40 09 354A, or DE 101 27 136 A1.

With all these bridges, which can be launched with a projecting front section, special attention is paid to the parts required for the launching process. The mechanism must be designed such that it can support the forces arising in the projecting front section, such that the bridge can be moved without jamming or canting, and such that premature wear does not occur. To this end, the bridge-launching vehicles have pairs of support rollers that work with matching running surfaces on the bridge, permitting movement of the bridge. Motors and gearboxes to set the bridge in motion are also provided. Lastly, devices are also provided on the transport and launching vehicles to permit assembly of the bridge, which is disassembled during transport. In all cases, the launching devices are a permanent part of the launching vehicle.

It has been demonstrated in military practice that when they are needed by the troops, the launching vehicles, regardless of whether or not they are armored, are not available in adequate numbers, or are not available in time, or are not available at all. Frequently, however, other vehicles, especially light armored vehicles, are available but cannot be used for lack of launching equipment.

SUMMARY OF THE INVENTION

It is therefore an object of the present invention to provide an attachment for transporting and launching military bridges, with the aid of which light armored vehicles can be given the capability to transport, launch, and recover military bridges.

This object is attained, in an embodiment, through an attachment of the generic type, including: a deck adapter with a crossbeam, feet for removable attachment to the upper deck, and support rollers for the bridge and a front adapter with a framework matched to the bow of the vehicle and to be removably attached to the bow, a launching beam with a lower roller block, an upper roller block and a motor-driven pinion, attached to the framework in a pivoting manner, a support foot attached to the framework in a pivoting manner, front supports with a crossbeam and support rollers for the bridge, a first lifting cylinder between the framework and the launching beam, and a second lifting cylinder between the framework and the support foot.

Thus, any vehicle with sufficient load capacity, for example, a light armored vehicle, can be used with modest design and financial expenditure as a transport and launching vehicle for military bridges. To this end, the front adapter that is to be attached to the bow of the vehicle is equipped with a pivoting support foot that supports the weight of the bridge during launching and recovery without stressing the vehicle, and with a launching beam that effects the motorized advance and retraction of the bridge. A deck adapter that can be removably attached to the top deck of the vehicle at its stern is primarily needed during transport of the bridge.

According to a further development of the invention, a motor that drives the pinion, in particular a hydraulic motor, can be provided on the launching beam.

A movably articulated pressure foot can be provided on the support foot. Thanks to this mobility, it always finds secure footing even on uneven ground.

According to a further development of the invention, a lever for raising and lowering the bridge can be attached to the support foot in a movably articulated manner. The purpose of this lever is to raise the bridge from a resting position on the vehicle to the proper position for the launching process and vice versa.

According to a further development of the invention, movable pressure feet can be provided on the framework. These pressure feet support themselves, and hence the front adapter, against the underside of the vehicle, where they always make secure contact thanks to their mobility.

A hydraulic system that supplies the motor and the cylinder can be provided to complete the front adapter.

In addition, an electronic system that controls the sequence of operation can be provided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
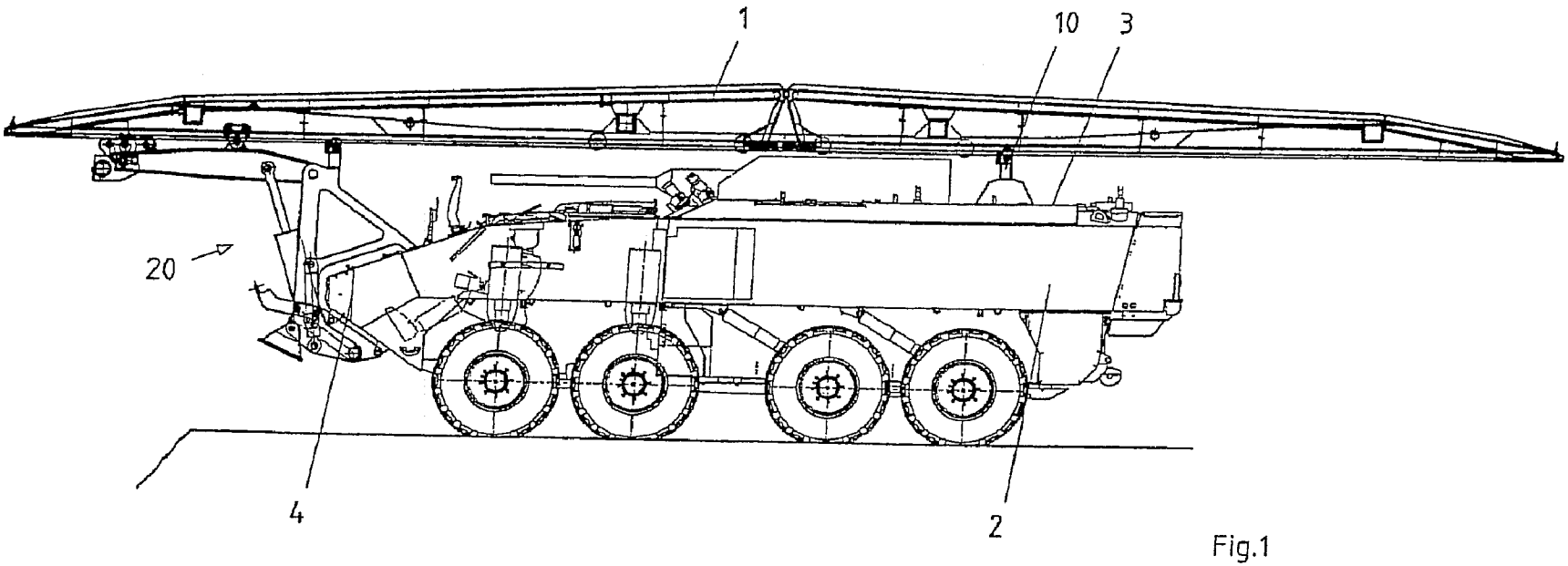
FIG. 1 illustrates a light armored vehicle that carries a military bridge with the aid of a front adapter and a deck adapter.

FIG. 1 shows a purely schematic side view of a military bridge 1 on a light armored wheeled vehicle 2. The vehicle 2 has, insofar as is relevant to the present invention, a rear upper deck 3 and a bow 4, which in this case is approximately V-shaped.

Figure 2:
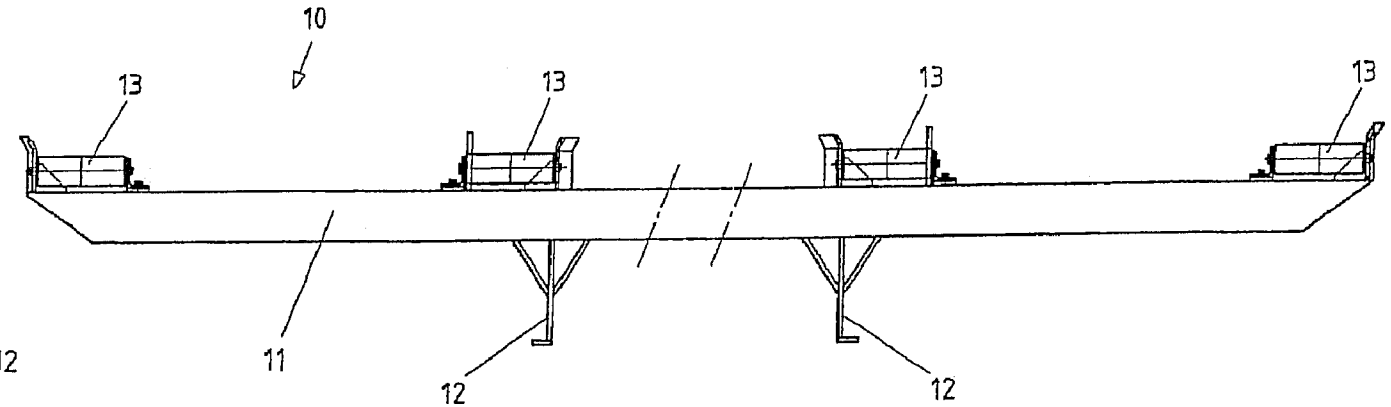
FIG. 2 illustrates a view of the deck adapter.
Figure 3:
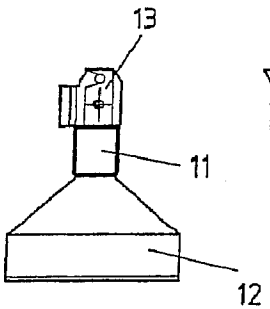
FIG. 3 illustrates a side view of the deck adapter from FIG. 2.

Visible on the upper deck 3 is a deck adapter 10 that carries the bridge 1 and is described in detail using FIGS. 2 and 3.

Visible on the bow 4 of the vehicle 2 is a front adapter 20, which is described in detail using FIGS. 4 through 8. The front adapter is detachably mounted on the bow 4 of the vehicle 2 with the aid of appropriate fasteners (not further shown), wherein care has been taken in the design to avoid obstructing the vehicle driver's field of view.

FIG. 2, as a front view, and FIG. 3, as a side view, show the deck adapter 10. This includes a crossbeam 11 that can be detachably fastened to the upper deck 3 of the vehicle with the aid of feet 12. The crossbeam 11 carries four support rollers 13 on which the bridge 1 is rolled.

Figure 4:
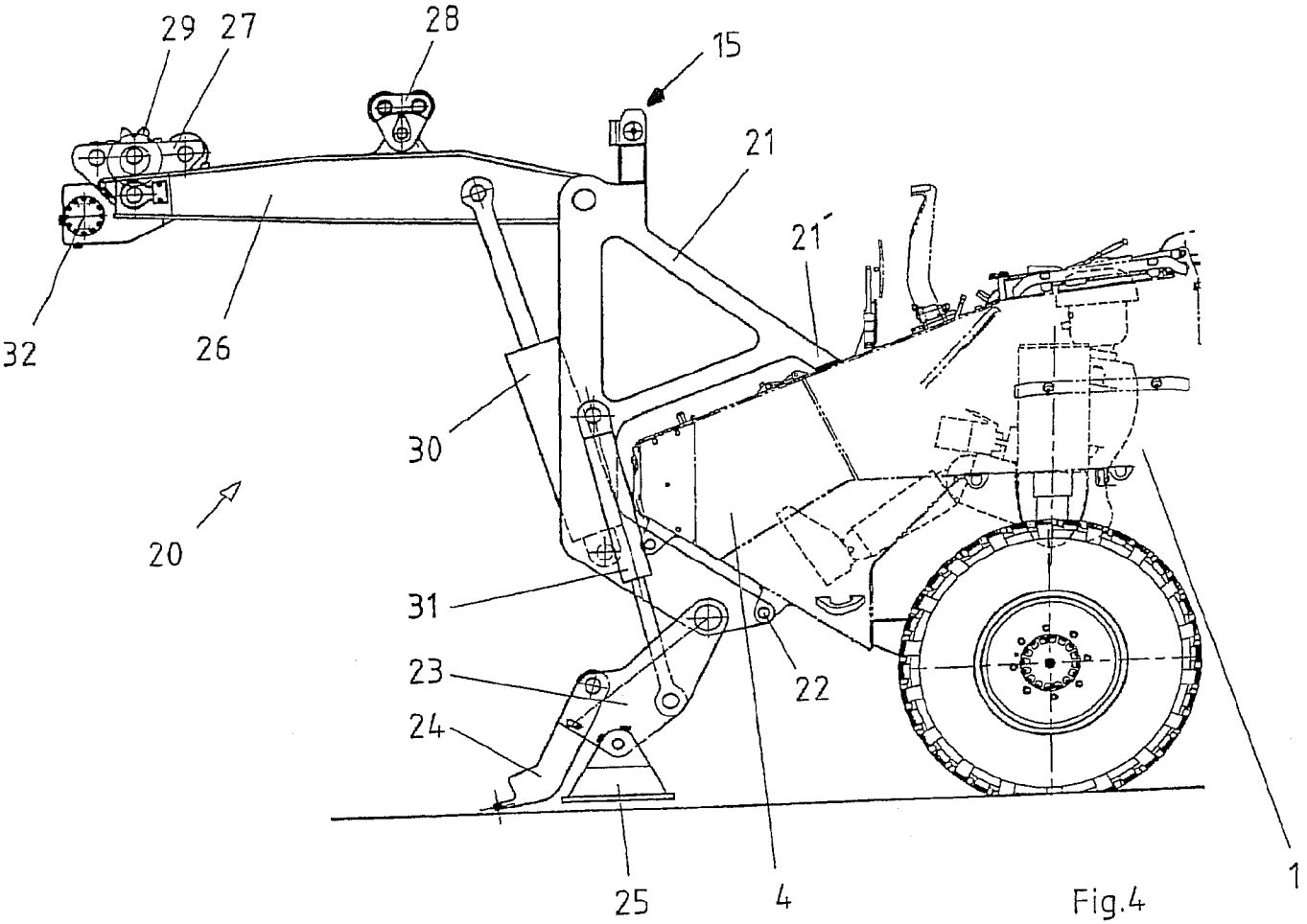
FIG. 4 illustrates an enlarged side view of the front adapter installed on the vehicle.

FIG. 4 shows, at an enlarged scale, the bow 4 of the vehicle 1 with installed front adapter 20. The front adapter 20 has a framework 21 that is fastened to the bow 4 with the aid of a fastening device 21' and the attachment points 22. A foot lever 23 is attached to the underside of the framework 21 in a movably articulated manner. The foot lever 23 can be raised and lowered with the aid of a hydraulic cylinder 31. A pressure foot 25 is attached to the underside of the foot lever 23 in a movably articulated manner. Once the support foot 23 is fully lowered, the pressure foot 25 is supported on the ground, where it always rests securely, even on uneven ground, thanks to the movably articulated attachment.

As the drawing shows, a lever 24 for raising and lowering the bridge 1 is also attached to the foot lever 23 in a movably articulated manner; its function will be described with reference to FIG. 8.

Figure 5:
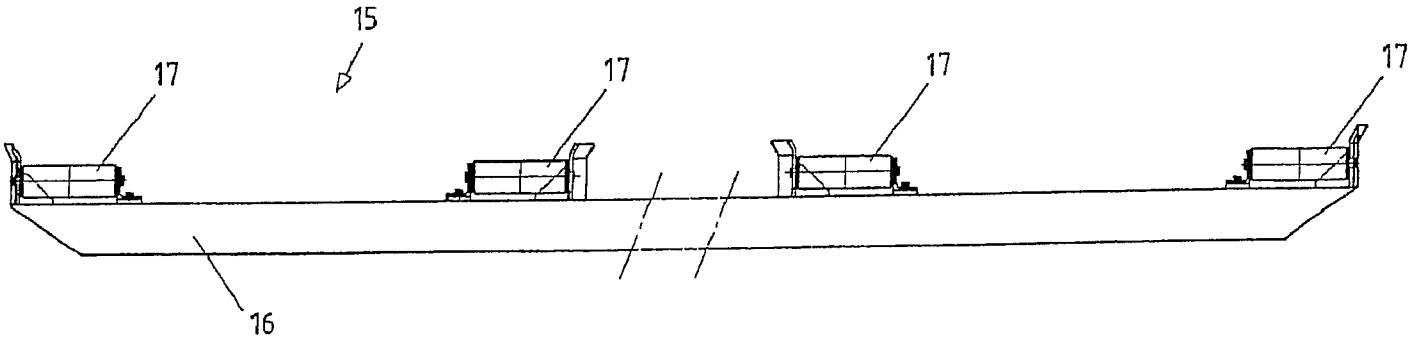
FIG. 5 illustrates a view of a front support, part of the front adapter.
Figure 6:
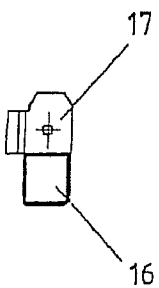
FIG. 6 illustrates a side view of the front support from FIG. 5.

Visible at the upper end of the framework 21 is, firstly, a front support 15, which is described in detail using FIGS. 5 and 6. Also visible is a launching beam 26, which is raised and lowered with the aid of a hydraulic cylinder 30. The launching beam 26 has a lower roller block 27, an upper roller block 28, a pinion 29, and a motor, in particular a hydraulic motor 32, which drives the pinion 29. The bridge 1 is moved forwards and backwards with the aid of the pinion 29.

FIG. 5 shows a front view, and FIG. 6 a side view, of the front support 15. It consists of a crossbeam 16, to the upper side of which are attached support rollers 17 and lateral guide strips for the bridge 1. The front support 15 does not need feet, as it is attached directly to the framework 21 of the front adapter 20.

Figure 7:
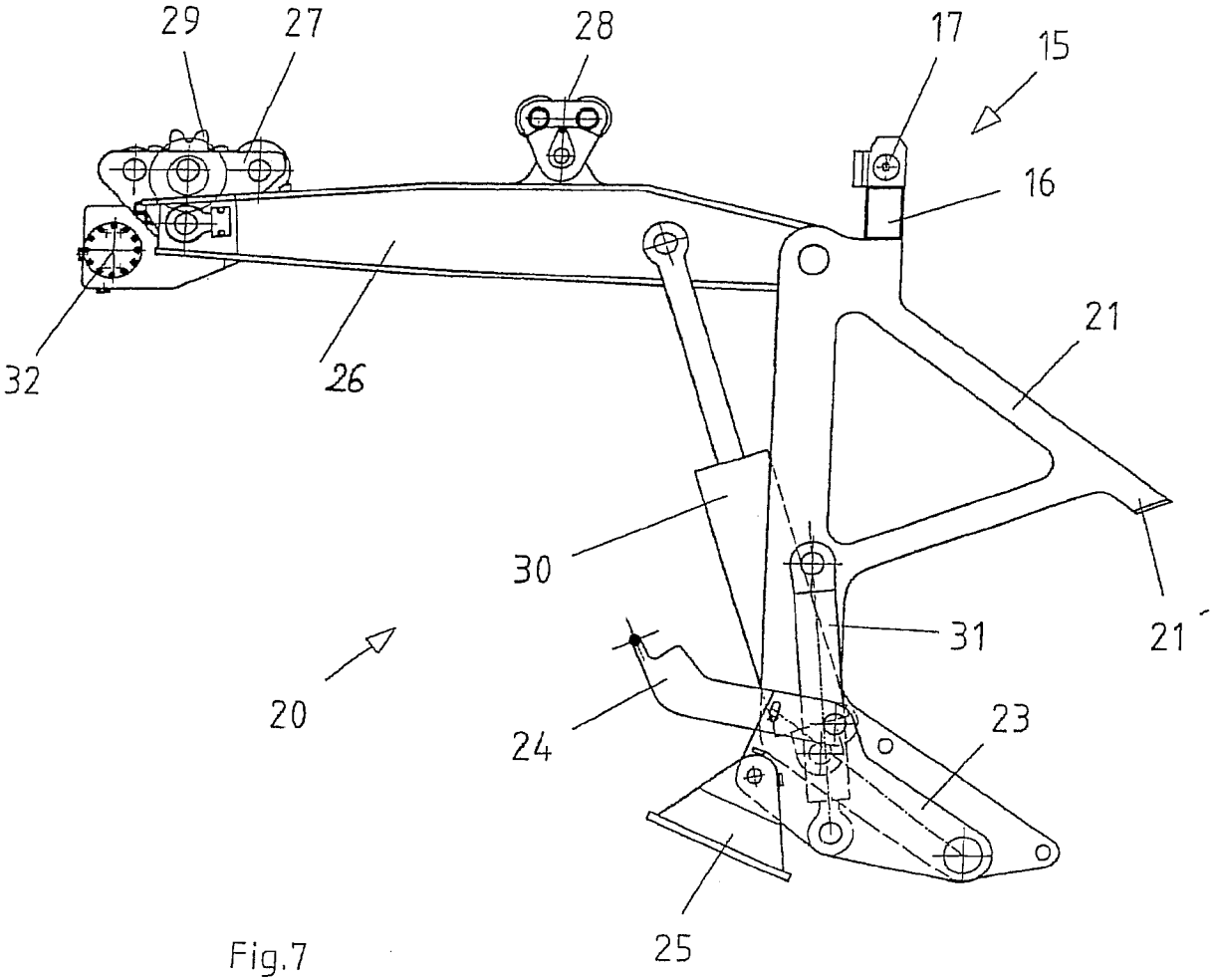
FIG. 7 illustrates the front adapter in a partially activated state.

FIG. 7 shows the front adapter 20 in a partially activated position. The support foot 23, 24, 25 is raised so that the vehicle 1 can move without difficulty.

Figure 8:
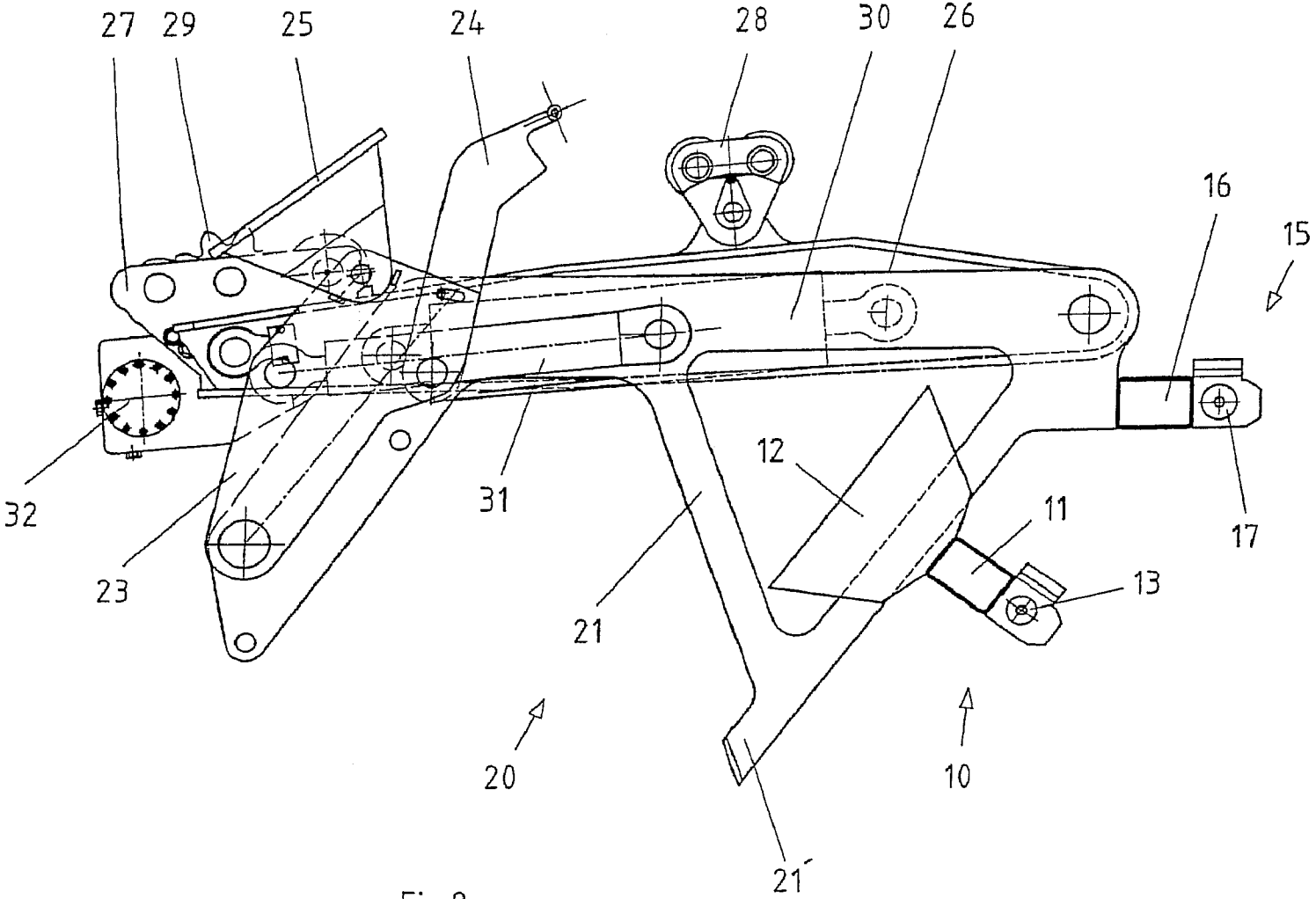
FIG. 8 illustrates the front adapter and deck adapter in a space-saving folded transport configuration.

FIG. 8 shows the front adapter 20 and the deck adapter 10 in a folded transport configuration. The deck adapter 10 is attached with the aid of its foot 12 to the framework 21 of the front adapter 20. The two hydraulic cylinders 30, 31 are retracted, resulting in a space-saving configuration. The lever 24 is raised. If the bridge 1 sits between the upper roller block 28 and the lower roller block 27 or pinion 29—unlike the situation shown in the drawing—it can be raised by the lever 24 as far as is required for launching.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An attachment for transporting and launching military bridges with a light armored vehicle having an upper deck and a bow, the attachment comprising:

a deck adapter having a crossbeam, at least one foot for removable attachment to the upper deck, and at least one support roller for the bridge; and a front adapter having a framework that is configured to match the bow of the vehicle and is configured to be removably attached to the bow;

a launching beam with a lower roller block;

an upper roller block;

a motor-driven pinion pivotably attached to the framework;

a support foot pivotably attached to the framework;

a front support having a crossbeam and at least one support roller for the bridge;

a first lifting cylinder provided between the framework and the launching beam; and a second lifting cylinder provided between the framework and the support foot.

2. The attachment according to claim 1, further comprising a motor provided on the launching beam for driving the pinion.

3. The attachment according to claim 1, further comprising a pressure foot attached to the support foot in a movably articulated manner.

4. The attachment according to claim 1, further comprising a lever attached to the support foot in a movably articulated manner for raising and lowering the bridge that is resting on the vehicle.

5. The attachment according to claim 1, further comprising a fastening device and lower attachment points provided between the framework and the vehicle bow.

6. The attachment according to claim 1, further comprising a hydraulic system that supplies the motor and the cylinders.

7. The attachment according to claim 1, further comprising an electronic system that controls a sequence of operation.

* * * * *